US010464777B1

(12) United States Patent
Feng

(10) Patent No.: US 10,464,777 B1
(45) Date of Patent: Nov. 5, 2019

(54) YARN FEEDER

(71) Applicant: Shen-Te Feng, Taichung (TW)

(72) Inventor: Shen-Te Feng, Taichung (TW)

(73) Assignee: Sunshine Kinetics Technology Co. Ltd, Taichung (TW)

( * ) Notice: Subject to any disclaimer, the term of this patent is extended or adjusted under 35 U.S.C. 154(b) by 36 days.

(21) Appl. No.: 15/962,715

(22) Filed: Apr. 25, 2018

(51) Int. Cl.

| | |
|---|---|
| ***B65H 54/44*** | (2006.01) |
| ***B65H 49/34*** | (2006.01) |
| ***B65H 49/26*** | (2006.01) |
| ***B65H 54/72*** | (2006.01) |
| ***B65H 54/74*** | (2006.01) |

(52) U.S. Cl.
CPC ..... *B65H 54/44* (2013.01); *B65H 49/26* (2013.01); *B65H 49/34* (2013.01); *B65H 54/72* (2013.01); *B65H 54/74* (2013.01); *B65H 2403/92* (2013.01); *B65H 2701/31* (2013.01)

(58) Field of Classification Search
CPC ..... B65H 49/26; B65H 49/34; B65H 54/44; B65H 54/72; B65H 54/74; B65H 2701/31
See application file for complete search history.

(56) References Cited

U.S. PATENT DOCUMENTS

| | | | | |
|---|---|---|---|---|
| 4,003,525 A * | 1/1977 | Podvin | ..... | B65H 49/26 242/420.6 |
| 10,246,291 B2 * | 4/2019 | Feng | ..... | B65H 59/387 |
| 2017/0064933 A1 * | 3/2017 | Tseng | ..... | A01K 89/003 |

FOREIGN PATENT DOCUMENTS

| | | | | |
|---|---|---|---|---|
| FR | 2202290 A1 * | 5/1974 | ..... | B65H 51/04 |

* cited by examiner

*Primary Examiner* — William E Dondero
(74) *Attorney, Agent, or Firm* — Che-Yang Chen; Law Offices of Scott Warmuth

(57) ABSTRACT

A yarn feeder may comprise a metric-sized motor and a winding wheel, and a drive shaft axially protruding from a first end of the motor is configured to connect to a rotating member. The winding wheel formed in a tube shape comprises a first end and a second end, and an interior channel is adapted to axially penetrate through the winding wheel from the first end to the second end thereof. The interior channel is configured to accommodate the motor, and the rotating member is coupled with the interior channel such that the motor is configured to drive the winding wheel through the rotating member. The motor in the present invention is a metric-sized motor which is not only easy to buy in the market but also reduces manufacturing cost and the volume of the yarn feeder.

8 Claims, 8 Drawing Sheets

A-A

YARN FEEDER

FIELD OF THE INVENTION

The present invention relates to a yarn feeder and more particularly to a low-cost and space-saving yarn feeder.

BACKGROUND OF THE INVENTION

Generally, a conventional yarn feeder has a winding wheel secured on a shaft, and an end of the shaft is pivotally connected to a frame while a body portion thereof is connected to a rim. Moreover, the rim is connected to a driving motor through a belt member such that the driving motor can drive the winding wheel to achieve the yarn winding.

However, the conventional yarn feeder is disadvantageous because: the driving motor can only indirectly drive the winding wheel through the belt member, and since the yarning process usually needs hundreds of yarn feeders to work together, the space-consuming components such as the driving motor, the belt member and the winding wheel may lead to severe problem in space arrangement of a factory. Therefore, there remains a need for a new and improved design for a yarn feeder to overcome the problems presented above.

SUMMARY OF THE INVENTION

The present invention provides a yarn feeder which comprises a motor and a winding wheel, and a drive shaft axially protruding from a first end of the motor is configured to connect to a rotating member. The first end of the motor comprises a plurality of axial first through holes at eccentric positions, and each of the first through holes is adapted to be engaged with one end of a screw rod. Furthermore, the screw rods are configured to extend to a second end of the motor which is coupled with a bottom board, and the bottom board comprises a plurality of axial second through holes which are configured to engage with the other ends of the screw rods respectively, thereby securing the motor on the bottom board. In addition, a tube body axially extending from a center portion of the bottom board has a wire hole thereon which is located close to the bottom board. Moreover, the motor connects to a wire which is configured to pass through the wire hole into the tube body and pass out of a rear end of the tube body which is located away from the bottom board. Also, the tube body is adapted to pass through and secure on a fixed body to suspend the motor in the air. The winding wheel formed in a tube shape comprises a first end and a second end, and an interior channel is adapted to axially penetrate through the winding wheel from the first end to the second end thereof. The interior channel is configured to accommodate the motor, and the rotating member is coupled with the interior channel such that the motor is configured to drive the winding wheel through the rotating member. Each of the first end and the second end of the winding wheel has a ring body disposed thereon. Moreover, a plurality of arc-shaped elastic strips are arranged around the winding wheel, and each of the elastic strips has two ends respectively connected to the two ring bodies. Thus, when a yarn roll is disposed on the winding wheel, the elastic strips are configured to abut against an inner periphery of the yarn roll so as to enable the yarn roll to be securely disposed on the winding wheel. In addition, a bearing, which is positioned in the interior channel close to the second end of the winding wheel, is adapted to be penetrated through by the tube body.

In one embodiment, the rotating member is a rotating disc, and an outer periphery of the rotating member has at least a locating recess; the winding wheel has at least a locating bar protruding from an inner surface of the interior channel, and the locating recess is adapted to couple with the locating bar.

In another embodiment, the winding wheel is made of aluminum alloy, and the locating bar is formed through the aluminum extrusion processing.

In still another embodiment, the locating bar having an axial connecting hole thereon is configured to axially extend from the first end of the winding wheel toward, but not reaching, the second end of the winding wheel, and a slot is formed in the interior channel at the second end of the winding wheel; a tube cover is positioned in the slot, and a bolt axially penetrating through the tube cover is configured to screw in the connecting hole of the locating bar, and the tube cover has an accommodating recess which is adapted to accommodate the bearing therein.

In a further embodiment, a third through hole axially penetrating through the tube cover is located at a position aligned with a center of the bearing, and the tube body of the motor is configured to penetrate through the bearing and the third through hole; a first lock member is coupled with the tube cover to prevent the bearing from detaching from the tube cover.

In still a further embodiment, a second lock member and a third lock member are coupled on the tube body to secure the bearing therebetween, thereby fixing a relative position between the bearing and the tube body.

In a preferred embodiment, two plugs are configured to respectively cover and block the first end and the second end of the winding wheel to achieve the dustproof effect for the interior channel.

In an advantageous embodiment, an outer surface of the tube body comprises a threaded section, and two nuts are configured to engage with the threaded section to secure the fixed body therebetween.

Comparing with conventional yarn feeder, the present invention is advantageous because: the motor is a metric motor which not only is easy to buy in the market but also reduces the cost in manufacture and the volume of the yarn feeder.

DETAILED DESCRIPTION OF THE INVENTION

Figure 1:
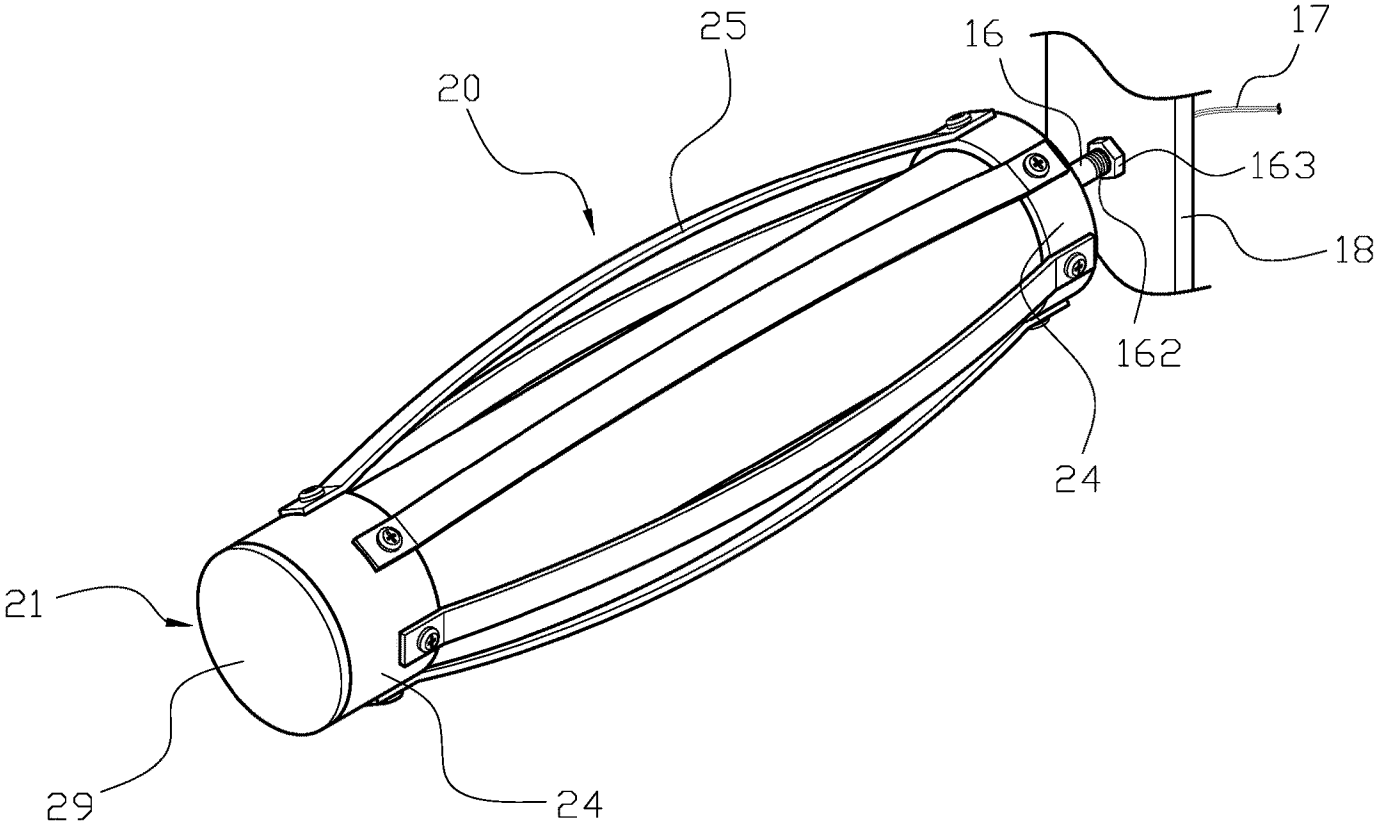
FIG. 1 is a three-dimensional assembly view of a yarn feeder in the present invention.
Figure 2:
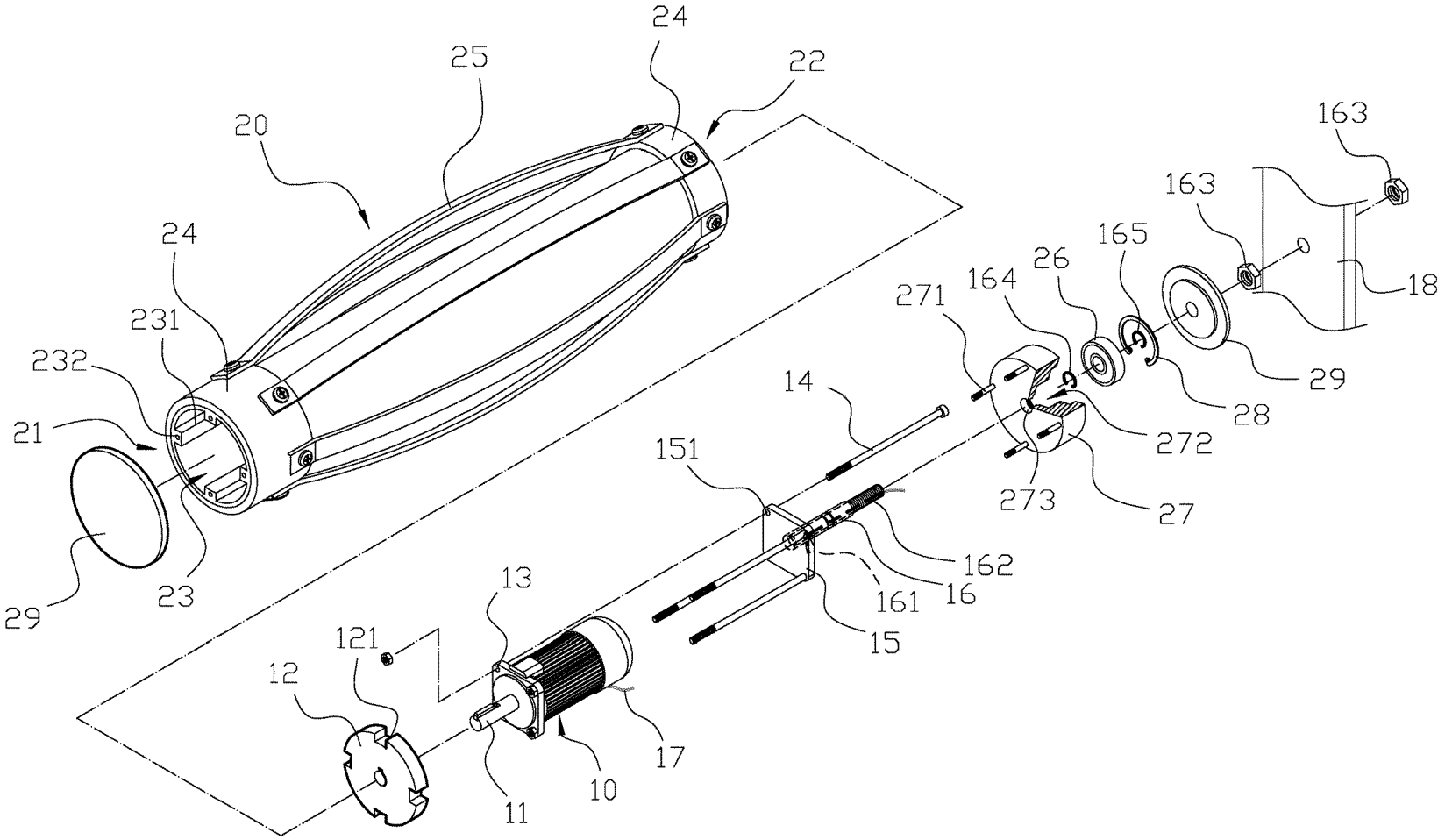
FIG. 2 is a three-dimensional exploded view of the yarn feeder in the present invention.
Figure 3:
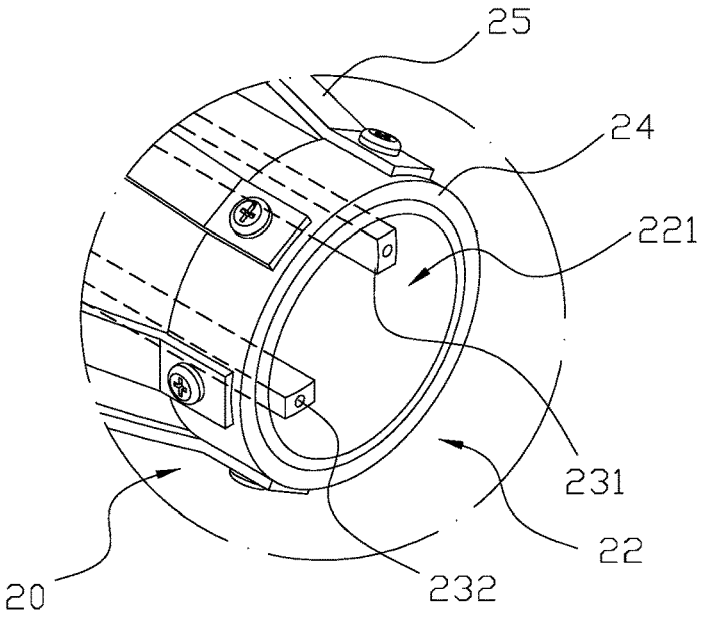
FIG. 3 is a partial enlarged drawing of a second end of a winding wheel of the yarn feeder in the present invention.
Figure 4:
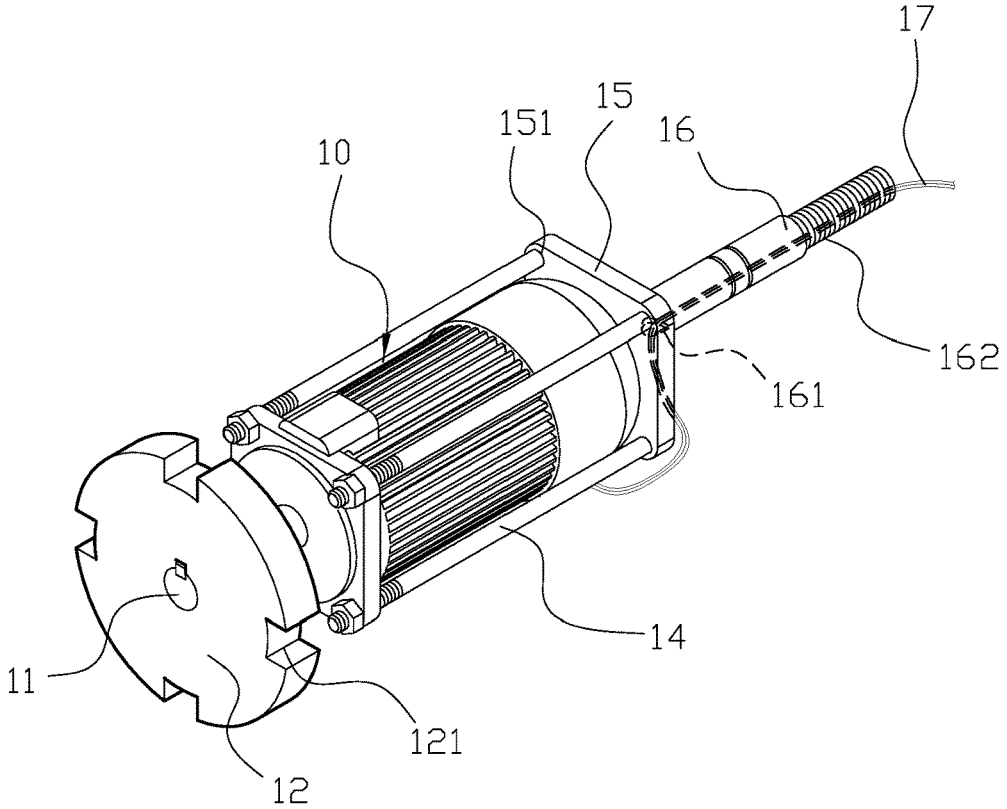
FIG. 4 is a three-dimensional view illustrating a motor and a bottom board of the yarn feeder are connected in the present invention.
Figure 5:
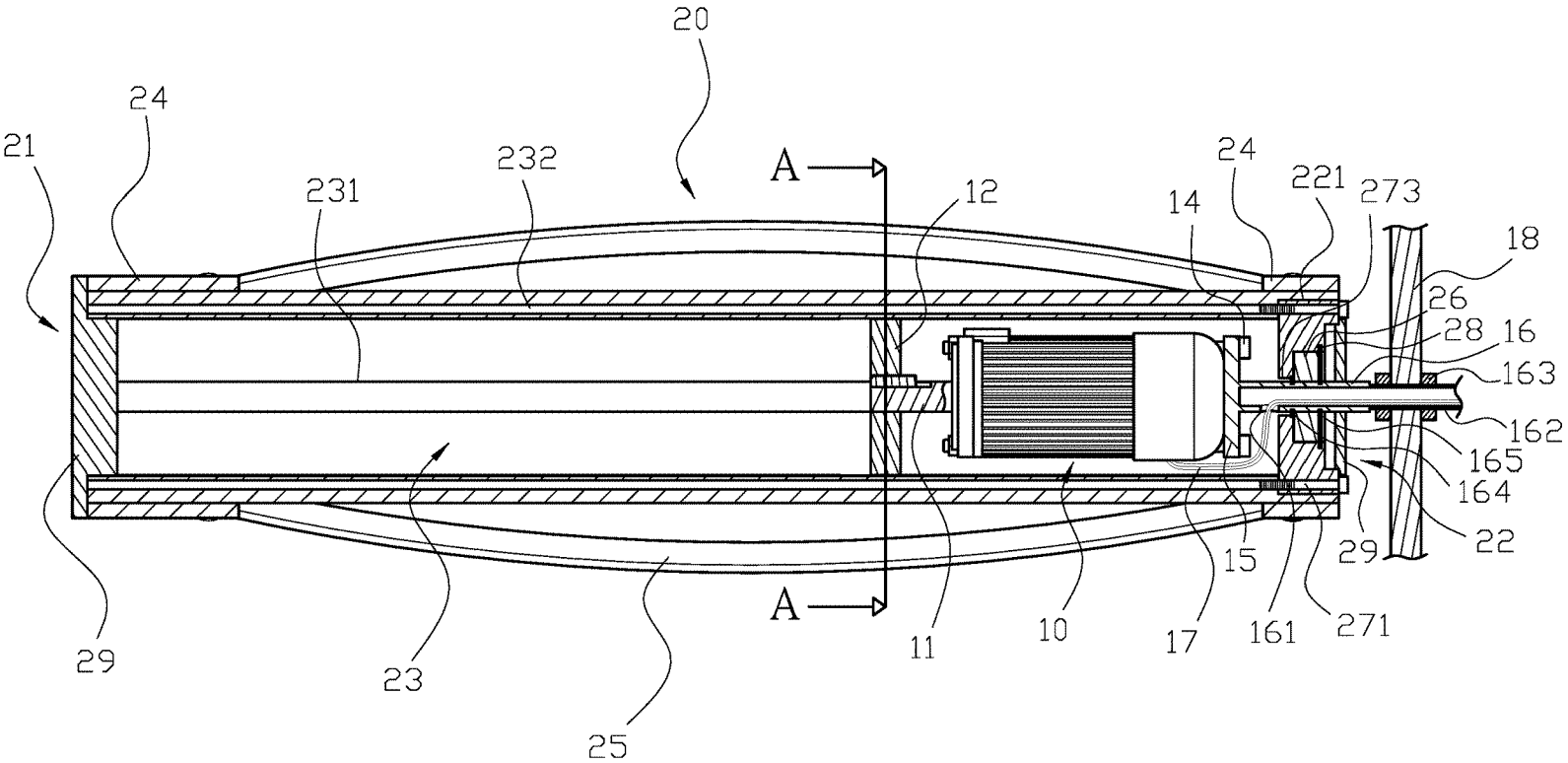
FIG. 5 is a sectional view of the yarn feeder in the present invention.
Figure 6:
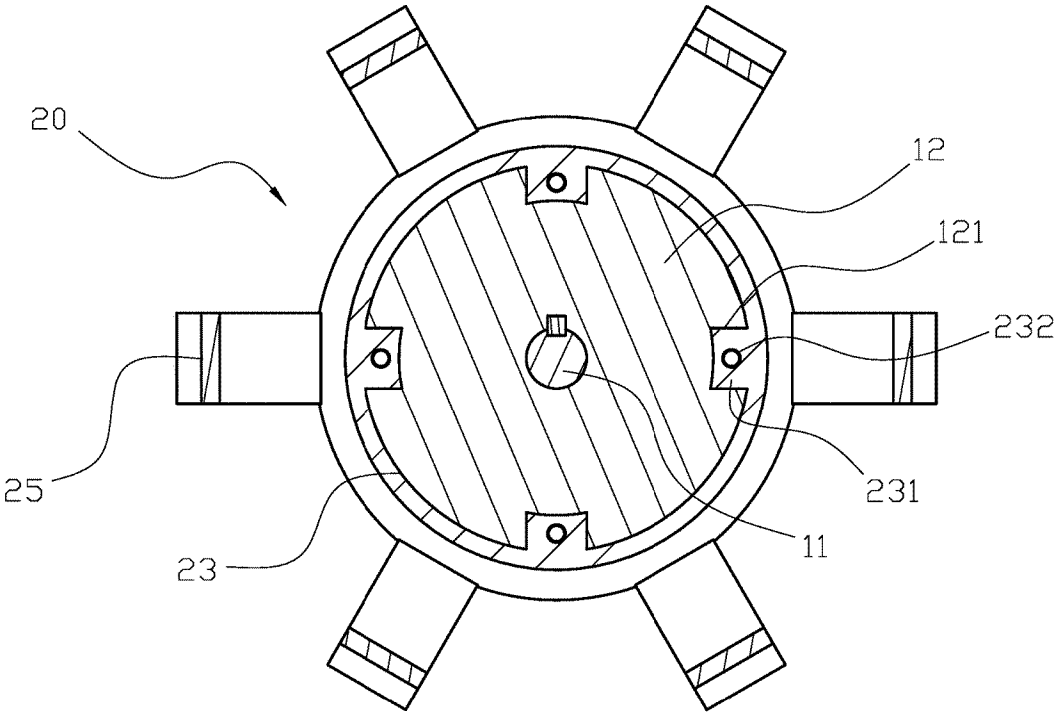
FIG. 6 is a sectional view along line A-A of FIG. 5.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a yarn feeder which comprises a metric-sized motor (10) and a winding wheel (20). A drive shaft (11) axially protruding from a first end of the motor (10) is configured to connect to a rotating member (12), and an outer periphery of the rotating member (12) has at least a locating recess (121). Moreover, the first end of the motor (10) comprises a plurality of axial first through holes (13) at eccentric positions, and each of the first through holes (13) is adapted to be engaged with one end of a screw rod (14). Furthermore, the screw rods (14) are configured to extend to a second end of the motor (10) which is coupled with a bottom board (15), and the bottom board (15) comprises a plurality of axial second through holes (151) which are configured to engage with the other ends of the screw rods (14) respectively, thereby securing the motor (10) on the bottom board (15). In addition, a tube body (16) axially extending from a center portion of the bottom board (15) has a wire hole (161) thereon which is located close to the bottom board (15). Moreover, the motor (10) connects to a wire (17) which is configured to pass through the wire hole (161) into the tube body (16) and pass out of a rear end of the tube body (16) which is located away from the bottom board (15). Also, the tube body (16) is adapted to pass through and secure on a fixed body (18) to suspend the motor (10) in the air. Furthermore, an outer surface of the tube body (16) comprises a threaded section (162), and two nuts (163) are configured to engage with the threaded section (162) to secure the fixed body (18) therebetween. The winding wheel (20) formed in a tube shape comprises a first end (21) and a second end (22), and an interior channel (23) is adapted to axially penetrate through the winding wheel (20) from the first end (21) to the second end (22) thereof. The interior channel (23) is configured to accommodate the motor (10) and the winding wheel (20) has at least a locating bar (231) protruding from an inner surface of the interior channel (23), wherein the winding wheel (20) is made of aluminum alloy, and the locating bar (231) is formed through the aluminum extrusion processing.

When the motor (10) is positioned into the interior channel (23), the locating recess (121) of the rotating member (12) is configured to couple with the locating bar (231) such that the motor (10) is adapted to drive the winding wheel (20) through the rotating member (12). Each of the first end (21) and the second end (22) of the winding wheel (20) has a ring body (24) disposed thereon. Moreover, a plurality of arc-shaped elastic strips (25) are arranged around the winding wheel (20), and each of the elastic strips (25) has two ends respectively connected to the two ring bodies (24). Thus, when a yarn roll (30) is disposed on the winding wheel (20), the elastic strips (25) are configured to abut against an inner periphery of the yarn roll (30) so as to enable the yarn roll (30) to be securely disposed on the winding wheel (20). In addition, a bearing (26), which is positioned in the interior channel (23) close to the second end (22) of the winding wheel (20), is adapted to be penetrated through by the tube body (16). The locating bar (231) having an axial connecting hole (232) thereon is configured to axially extend from the first end (21) of the winding wheel (20) toward, but not reaching, the second end (22) of the winding wheel (20), and a slot (221) is formed in the interior channel (23) at the second end (22) of the winding wheel (20). A tube cover (27) is positioned in the slot (221), and a bolt (271) axially penetrating through the tube cover (27) is configured to screw in the connecting hole (232) of the locating bar (231). Furthermore, the tube cover (27) has an accommodating recess (272) which is configured to accommodate the bearing (26) therein, and the tube body (16) is configured to penetrate through the tube cover (27) and the bearing (26) to support the winding wheel (20), and the metric-sized motor (10) is used to reduce the volume and manufacturing cost of the yarn feeder of the present invention. A third through hole (273) axially penetrating through the tube cover (27) is located at a position aligned with a center of the bearing (26), and the tube body (16) of the motor (10) is configured to penetrate through the bearing (26) and the third through hole (273). Moreover, a first lock member (28) is coupled with the tube cover (27) to prevent the bearing (26) from detaching from the tube cover (27). In addition, a second lock member (164) and a third lock member (165) are coupled on the tube body (16) to secure the bearing (26) therebetween, and a relative position between the bearing (26) and the tube body (16) is secured to ensure installation positions of the winding wheel (20) and the motor (10). Furthermore, two plugs (29) are configured to respectively cover and block the first end (21) and the second end (22) of the winding wheel (20) to achieve the dustproof effect for the interior channel (23).

Structurally, referring to FIGS. 1 to 6, the rotating member (12) is securely disposed on the drive shaft (11) of the motor (10), and the bottom board (15) is abutted against the motor (10) to enable the two ends of each of the screw rods (14) to respectively engage with the second through hole (151) of the bottom board (15) and the first through hole (13) of the motor (10), thereby securing the motor (10) on the bottom board (15). Also, the wire (17) of the motor (10) is configured to pass through the wire hole (161) into the tube body (16). The motor (10) is positioned in the interior channel (23) at the second end (22) of the winding wheel (20), and the locating recess (121) of the rotating member (12) is coupled with the locating bar (231) protruding from the inner surface of the interior channel (23) to enable the winding wheel (20) and the rotating member (12) to have synchronous rotation. Also, the bearing (26) is installed in the accommodating recess (272) of the tube cover (27), and the first lock member (28) is coupled with the tube cover (27) to secure the position of the bearing (26). Furthermore, the second lock member (164) is coupled on the tube body (16), and the tube cover (27) and the bearing (26) are disposed on the tube body (16). The tube body (16) with the tube cover (27) and the bearing (26) is put into the interior channel (23) of the winding wheel (20), and the tube cover (27) is positioned in the slot (221) of the winding wheel (20). Thereafter, the bolt (271) is configured to screw in the connecting hole (232) of the locating bar (231) to enable the winding wheel (20) to connect the tube body (16) through the tube cover (27) and the bearing (26), and then the third lock member (165) is coupled on the tube body (16) to secure the bearing (26) between the second lock member (164) and the third lock member (165), thereby securing the relative position between the winding wheel (20) and the motor (10). Meanwhile, the rotating member (12), the bearing (26) and the tube cover (27) are configured to support the winding wheel (20) at the two ends thereof, and the bearing (26) is adapted to reduce the friction between the winding wheel (20) and the tube body (16). Also, the two plugs (29) are configured to respectively cover and block the first end (21) and the second end (22) of the winding wheel (20) to protect the motor (10) and bearing (26) in the interior channel (23) and to achieve the dustproof effect for the interior channel (23). Then, the tube body (16) of the motor (10) is configured to pass through and be secured on the fixed body (18), and the two nuts (163) engaging on the threaded section (162) of the tube body (16) is adapted to secure the fixed body (18) therebetween. Thus, with the bottom board (15) and the screw rods (14), the tube body (16) secured on a fixed body (18) enables the motor (10) to be suspended in the air, and the wire (17) passing through the tube body (16) is not blocked by the fixed body (18). It is noteworthy that the motor (10) used in the present invent is a metric-sized motor which not only is easy to buy in the market but also reduces manufacturing cost and the volume of the yarn feeder of the present invention.

Figure 7:
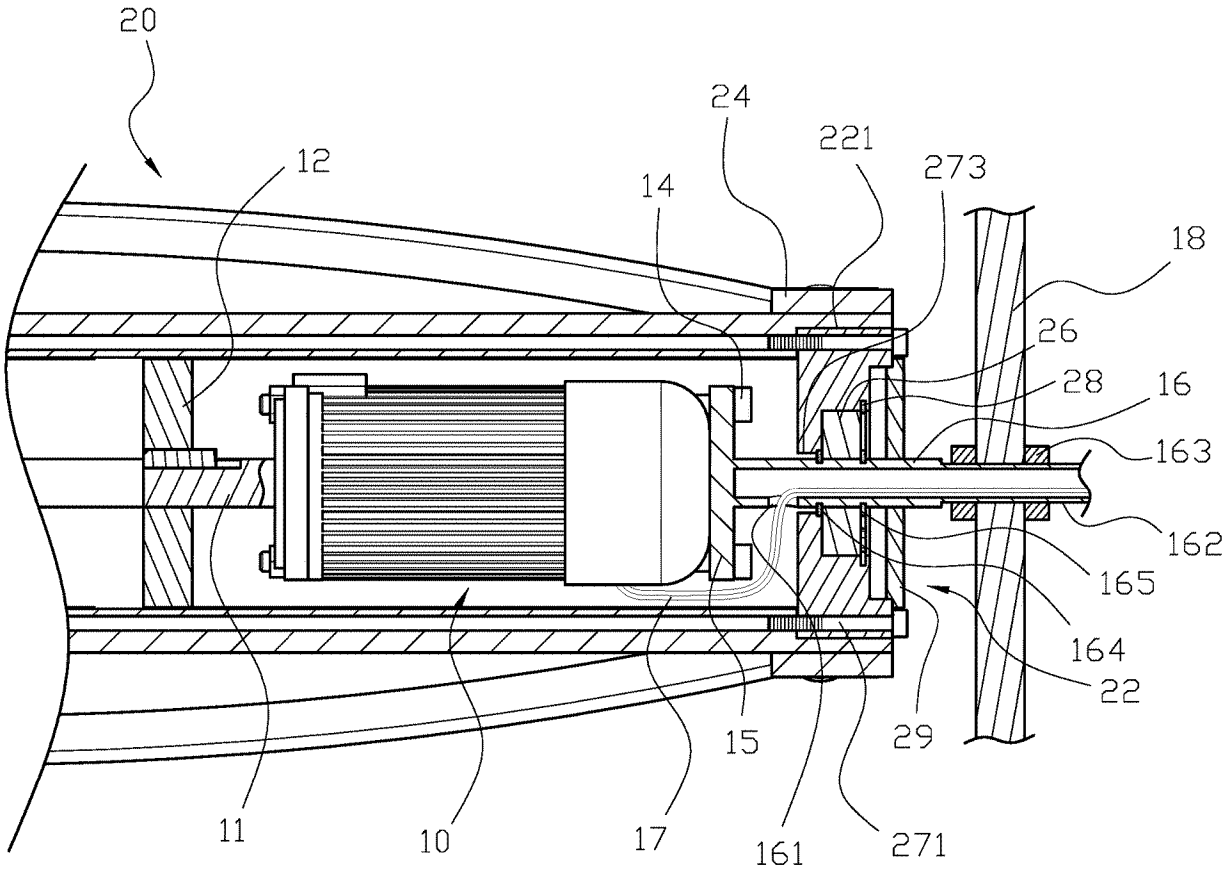
FIG. 7 is a partial enlarged sectional drawing of the yarn feeder of the present invention.
Figure 8:
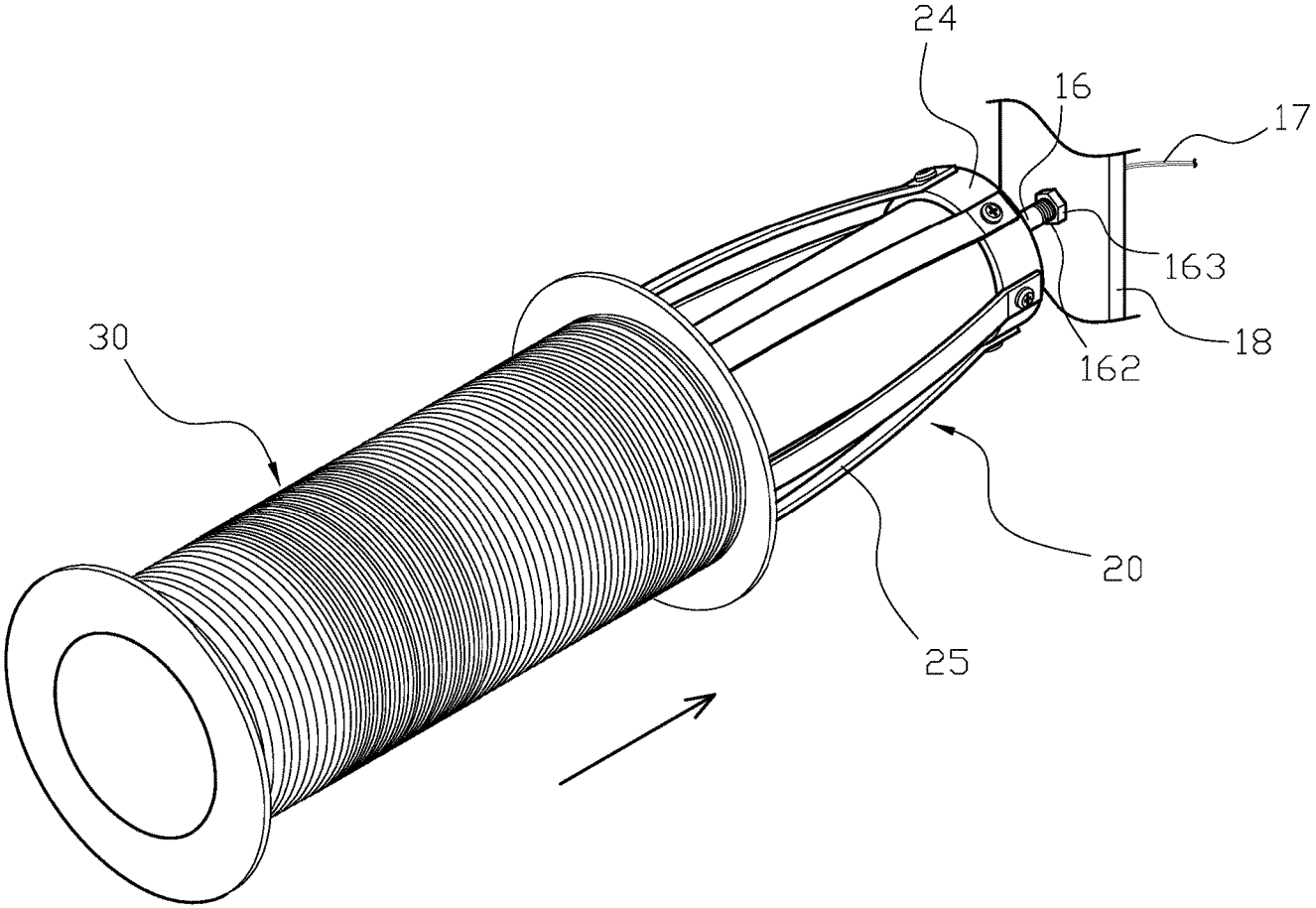
FIG. 8 is a first schematic view illustrating the yarn feeder of the present invention is in use.
Figure 9:
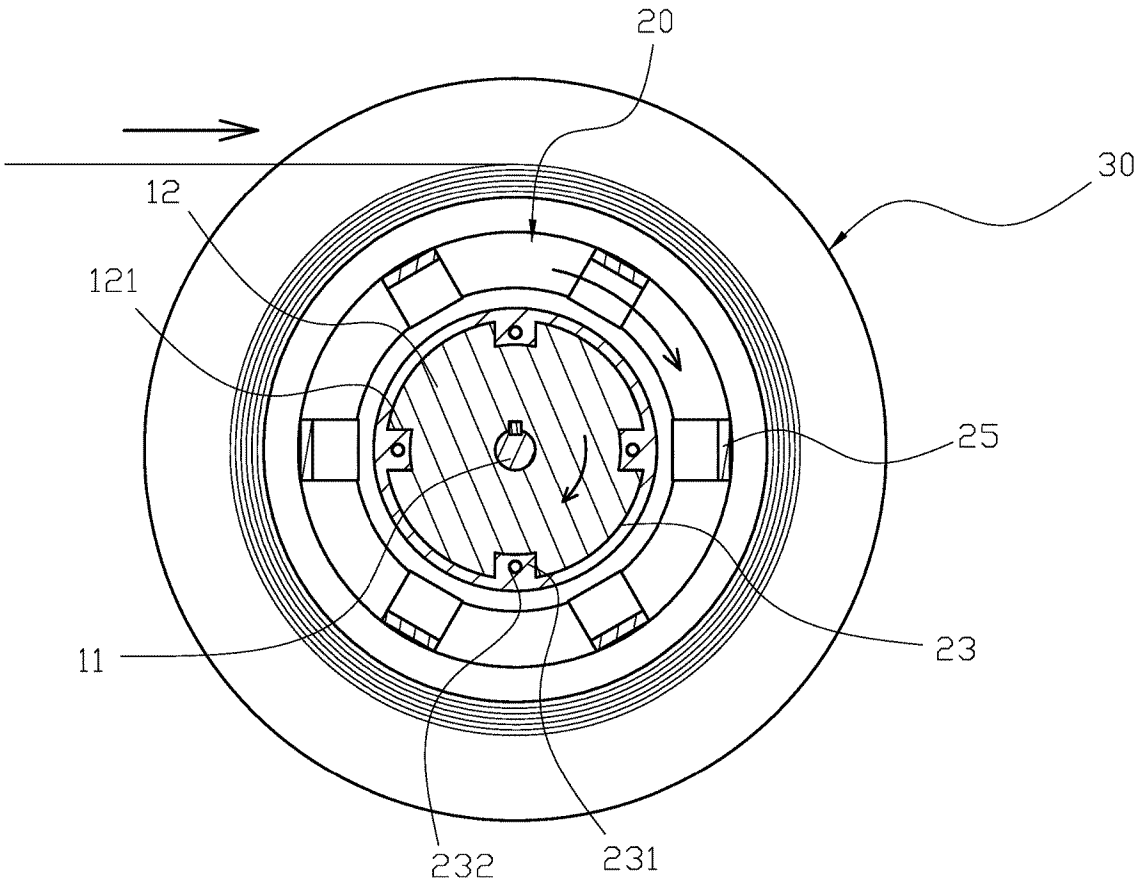
FIG. 9 is a second schematic view illustrating the yarn feeder of the present invention is in use.

In actual application, referring to FIGS. 7 to 9, the arc-shaped elastic strips (25) are arranged around the winding wheel (20), and each of the elastic strips (25) has two ends respectively connected to the two ring bodies (24). When the yarn roll (30) is disposed on the winding wheel (20), the elastic strips (25) are configured to abut against the inner periphery of the yarn roll (30) so as to enable the yarn roll (30) to be securely disposed on the winding wheel (20). Moreover, when the motor (10) is energized, the drive shaft (11) of the motor (10) is configured to drive and rotate the rotating member (12), and the locating recess (121) of the rotating member (12) which is coupled with the locating bar (231) of the winding wheel (20) is configured to drive the winding wheel (20) so as to enable the winding wheel (20) and the rotating member (12) to have synchronous rotation and achieves the yarn winding. The motor (10) is positioned in the interior channel (23) of the winding wheel (20) through the bottom board (15), and the tube body (16) extending from the bottom board (15) is configured to stick out of the winding wheel (20) to be secured on the fixed body (18). Additionally, through the tube cover (27) and the bearing (26) coupled on the tube body (16), the winding wheel (20) is configured to be driven by the motor (10) smoothly.

Comparing with conventional yarn feeder, the present invention is advantageous because: the motor (10) is a metric-sized motor which is not only easy to buy in the market but also reduces manufacturing cost and the volume of the yarn feeder.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A yarn feeder comprising:

a metric-sized motor, and a drive shaft, which axially protrudes from a first end of the motor, configured to connect to a rotating member; the first end of the motor comprising a plurality of axial first through holes at eccentric positions, and each of the first through holes adapted to be engaged with one end of a screw rod; the screw rods configured to extend to a second end of the motor which is coupled with a bottom board, and the bottom board comprising a plurality of axial second through holes which are configured to engage with the other ends of the screw rods respectively, thereby securing the motor on the bottom board; a tube body, which axially extends from a center portion of the bottom board, having a wire hole thereon which is located close to the bottom board; the motor connecting to a wire which is configured to pass through the wire hole into the tube body and pass out of a rear end of the tube body which is located away from the bottom board; the tube body adapted to pass through and secure on a fixed body to suspend the motor in the air; and a winding wheel, which is formed in a tube shape, comprising a first end and a second end, and an interior channel adapted to axially penetrate through the winding wheel from the first end to the second end thereof; the interior channel configured to accommodate the motor, and the rotating member coupled with the interior channel such that the motor configured to drive the winding wheel through the rotating member; each of the first end and the second end of the winding wheel having a ring body disposed thereon; a plurality of arc-shaped elastic strips arranged around the winding wheel, and each of the elastic strips having two ends respectively connected to the two ring bodies; when a yarn roll disposed on the winding wheel, the elastic strips configured to abut against an inner periphery of the yarn roll so as to enable the yarn roll to be securely disposed on the winding wheel; a bearing, which is positioned in the interior channel close to the second end of the winding wheel, adapted to be penetrated through by the tube body; and the tube body configured to penetrate through the tube cover and the bearing to support the winding wheel.

2. The yarn feeder of claim 1, wherein the rotating member is a rotating disc, and an outer periphery of the rotating member has at least a locating recess; the winding wheel has at least a locating bar protruding from an inner surface of the interior channel, and the locating recess is adapted to couple with the locating bar.

3. The yarn feeder of claim 2, wherein the winding wheel is made of aluminum alloy, and the locating bar is formed through the aluminum extrusion processing.

4. The yarn feeder of claim 2, wherein the locating bar having an axial connecting hole thereon is configured to axially extend from the first end of the winding wheel toward, but not reaching, the second end of the winding wheel, and a slot is formed in the interior channel at the second end of the winding wheel; a tube cover is positioned in the slot, and a bolt axially penetrating through the tube cover is configured to screw in the connecting hole of the locating bar, and the tube cover has an accommodating recess which is adapted to accommodate the bearing therein.

5. The yarn feeder of claim 4, wherein a third through hole axially penetrating through the tube cover is located at a position aligned with a center of the bearing, and the tube body of the motor is configured to penetrate through the bearing and the third through hole; a first lock member is coupled with the tube cover to prevent the bearing from detaching from the tube cover.

6. The yarn feeder of claim 1, wherein a second lock member and a third lock member are coupled on the tube body to secure the bearing therebetween, thereby fixing a relative position between the bearing and the tube body.

7. The yarn feeder of claim 1, wherein two plugs are configured to respectively cover and block the first end and the second end of the winding wheel to achieve the dust-proof effect for the interior channel.

8. The yarn feeder of claim 1, wherein an outer surface of the tube body comprises a threaded section, and two nuts are configured to engage with the threaded section to secure the fixed body therebetween.

* * * * *